United States Patent [19]

Krauss et al.

[11] 4,454,668

[45] Jun. 19, 1984

[54] APPARATUS FOR SMOOTHING AND DRYING DAMP LAUNDRY

[75] Inventors: Theo Krauss, Aue; Ludwig Herrmann, Bockau; Siegfried Minde, Aue, all of German Democratic Rep.

[73] Assignee: VEB Kombinat Textima, Karl-Marx-Stadt, German Democratic Rep.

[21] Appl. No.: 354,870

[22] Filed: Mar. 4, 1982

[30] Foreign Application Priority Data

Jul. 20, 1981 [DD] German Democratic Rep. ..... 231/908

[51] Int. Cl.[3] ..... D06F 65/10

[52] U.S. Cl. ..... 38/11; 38/55; 38/144; 34/116

[58] Field of Search ..... 34/123, 116, 117, 8; 38/1 R, 2, 11, 6, 44–55, 144

[56] References Cited

U.S. PATENT DOCUMENTS

| | | | |
|---|---|---|---|
| 1,595,480 | 8/1926 | Minton | 34/117 X |
| 2,568,451 | 9/1951 | Kahl | 38/11 |
| 2,647,845 | 8/1953 | Taylor et al. | 38/11 |
| 3,197,896 | 8/1965 | Fleissner | 38/49 X |
| 3,237,316 | 3/1966 | Sachs | 34/117 X |
| 3,797,141 | 3/1974 | Paizera | 38/11 |
| 3,816,941 | 6/1974 | Holik et al. | 34/117 X |
| 3,925,906 | 12/1975 | Chance et al. | 34/123 |
| 4,172,007 | 10/1979 | Kaukaanpaa | 34/117 X |

*Primary Examiner*—Werner H. Schroeder
*Assistant Examiner*—Andrew M. Falik
*Attorney, Agent, or Firm*—Jordan and Hamburg

[57] ABSTRACT

An apparatus for ironing laundry which comprises a heated, rotatable cylinder for pre-drying laundry to be ironed which is situated in an enclosed area to conserve heat. Laundry is directed around this pre-drying cylinder by a complementary pair of guiding conveyor belts and is then transferred to at least one cylinder and corresponding mangle trough for ironing. Laundry is directed through the mangle troughs and cylinders by means of an additional guiding belt.

4 Claims, 3 Drawing Figures

APPARATUS FOR SMOOTHING AND DRYING DAMP LAUNDRY

BACKGROUND OF THE INVENTION

This invention relates to an apparatus for smoothing and drying damp laundry, in which this apparatus comprises a heated, driven cylinder and a mangle trough, laundry guiding means for transporting the laundry associated with the heated, driven cylinder in such a way that they encircle the same to a very large extent.

PRIOR ART STATEMENT

The combination of a heated, activated cylinder with a multitrough mangle is already known (U.S. Pat. No. 3,634,956, Int. Cl.: D 06 f, 61/100). In this apparatus, the cylinder is enclosed to a very large extent by revolving laundry transporting belts and revolving laundry guiding belts. The laundry is laid on a separate conveyor and brought by this conveyor to the cylinder. The front edge of the piece of laundry falls from this conveyor into the entry nip formed by the cylinder and the revolving laundry transporting belts. The piece of laundry is moved between the laundry transporting belts and the laundry guiding belts on the outside of the cylinder jacket.

However, the aforementioned known apparatus does not provide for a condition in which the laundry is securely guided within the apparatus, while the maximum possible use is made of a quantity of heat, expenses involved with manufacture and servicing being held to a minimum.

OBJECT AND SUMMARY OF THE INVENTION

The main object of this invention is to provide an appartus for smoothing and drying damp laundry, in which a heated, driven cylinder, a transfer section and a trough mangle are protected as much as possible against ambient temperature, with the laundry pieces being fed to the cylinder without a separate feed conveyor and a separate intermediate conveyor from the trough mangle.

SUMMARY OF THE INVENTION

With the apparatus of this invention, it is possible to combine a pre-heating or pre-drying unit with a trough mangle, in which conveyor belts 3 are arranged, the utilization of which serves as a guide zone in the feed zone, as a guiding element in the vicinity of cylinder 2, and as a support and additional drying zone in the conveying zone, resulting in as much protection as possible for the laundry piece, in view of the fact that the conveyor system (conveyor belts 3 and laundry guiding belts 14) derives its movements by means of engagement with the circumference of cylinder 2, and that the conveyor system associated with the pre-heating or pre-drying unit operates independently from the conveyor system of the subsequently arranged trough mangle. Thereby, and through the rolling friction that is originated by the preheating or pre-drying unit, wear-and-tear on the laundry guiding belts 14 is correspondingly reduced. The screen-type structure of the conveyor belts 3, results in improved transport of the laundry piece, and additional drying in the transfer zone **3*b*. In addition, transport of the laundry piece is improved by the fact that, in each instance, one laundry guiding belt 14 will lie in the middle of the conveyor belt 3 and, in each instance, a laundry guiding belt 14 will lie in the spacings of the conveyor belts 3. Furthermore, a shorter sliding path for the laundry piece from the pre-heating or pre-drying unit to the trough mangle unit is created by the transfer zone 3*b* that extends up to the proximity of the entry nip 12 and by the convenient arrangement of the conveyor bracket 11, i.e., between the convex guiding elements 10*b***.

BRIEF DESCRIPTION OF THE DRAWINGS

One example of an embodiment of the invention is now explained in connection with FIGS. 1 to 3. In the drawings

DETAILED DESCRIPTION OF A PREFERRED EMBODIMENT

Figure 1:
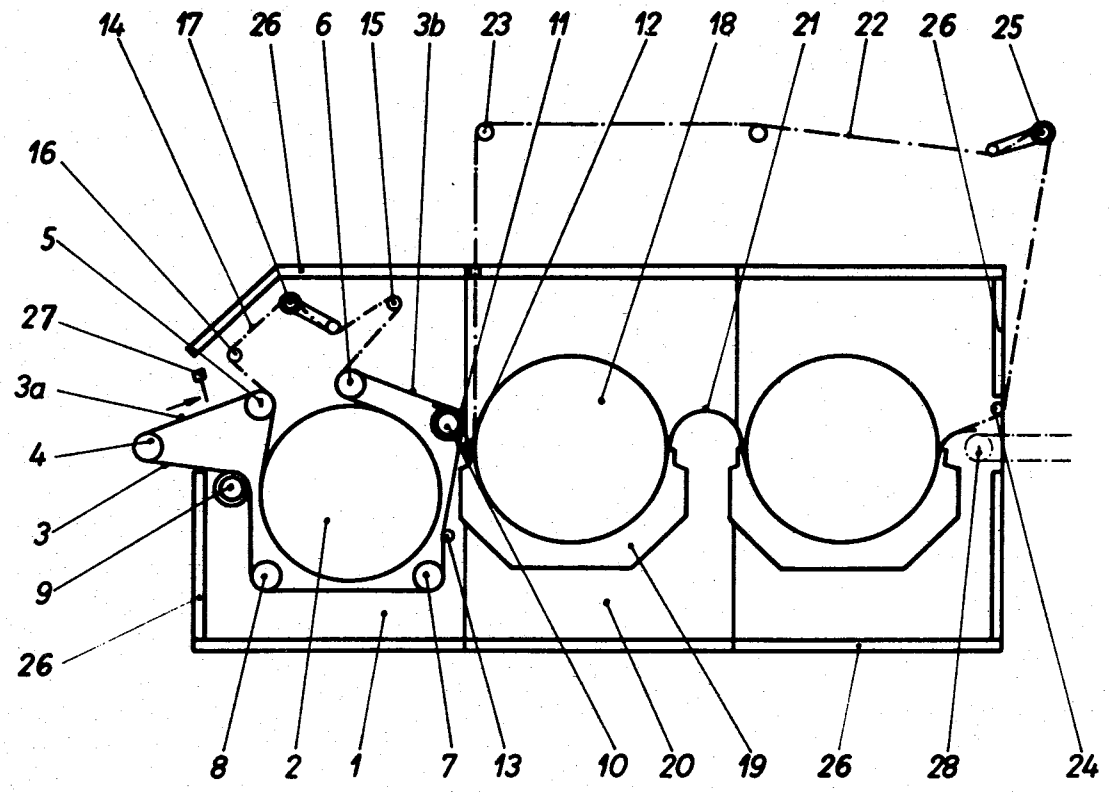
FIG. 1 illustrates a schematic representation of the apparatus for smoothing and drying damp laundry.

As is apparent from FIG. 1, a cylinder 2 is arranged on a frame 1. Several, and at least two conveyor belts 3, which are guided over reversing rollers 4, 5, 6, 7 and 8, as well as over the spherically shaped guiding rollers 9 and 10, revolve around the rotatably mounted driven cylinder 2, which may, for example, serve as a pre-heating or also as a pre-drying cylinder.

Reversing rollers 4, 5, 6, 7 and 8 as well as the guiding rollers 9 and 10 are also mounted on frame 1. The preferably screen-like structure of the conveyor belts 3 makes them air-permeable.

The guiding of the conveyor belts 3 occurs herein in such a way that they ascend upwardly between the reversing rollers 4 and 5, in other words in the direction of the laundry transport (represented symbolically in FIG. 1 by an arrow), thereby forming, at the same time, a favorable feed region **3*a* for placing of the laundry piece. The conveyor belts 3 encircle cylinder 2 as much as possible after the reversing roller 5**.

The reversing roller 6, viewed in a vertical direction, is preferably situated over the central axis, in the immediate proximity of the exterior of the circumference of cylinder 2. A transfer zone **3*b* is delineated by the previously described arrangement of shifting roller 6 and the arrangement of guiding roller 10 in the immediate proximity of the mangle trough 19 and next to entry nip 12 of mangle cylinder 18, and next to mangle cylinder 18 itself; which cause the conveyor belts 3 to form a trnasfer zone 3*b*. In transfer zone 3*b*, the laundry piece rests freely on the conveyor belts 3. In addition to the advantageous manner of guiding the conveyor belts 3 herein and the consequent advantageous transport of the laundry piece, an additional drying or pre-drying of the laundry piece here occurs, becaus of the temperature prevailing in the inside compartment of the apparatus of this invention, which is further promoted by the screen-type structure of conveyor belt 3**.

The guiding roller 10 is arranged directly in front of the mangle through intake, in other words in the vicinity of the entry nip 12. This guiding roller 10 effects the shifting and guiding of the conveyor belts 3. Transfer brackets or fingers 11 are preferably arranged between the conveyor belts 3 below the side carrying the laundry piece, in the area of guiding roller 10. These transfer brackets are further situated between the convex guiding elements **10*b* of guiding roller 10, and extend most extensively inside entry nip 12. The laundry piece is thereby slidably introduced from the transfer area 3***b* of the trough mangle.

Conveyor belts 3 are guided to the contact zone 3*a* by reversing shifting rollers 7, 8 and 4 and by the guiding roller 9. Guiding roller 9 is similar to the guiding roller 10, no transfer brackets 11 being provided since delivery of a laundry piece does not take place at this guiding roller 9. In order to stretch the conveyor belts correspondingly and maintain them under a predetermined tension, for example, a tensioning device 13 is arranged in the region where the conveyor belts 3 no longer transport the laundry piece. In FIG. 1, tensioning device 13 is preferably represented as a tensioning roller arranged in the area of the conveyor belts 3 between the guiding roller 10 and reversing roller 7. This position of tensioning arrangement 13 can be changed in relation to the conveyor belts 3 so that the contact pressure of the conveyor belts 3 onto cylinder 2 can be preferably adjusted. The tensioning arrangement 13 can be designed so each conveyor belt 3 can be tensioned separately through a tensioning roller. It is also possible, to use one or several of the reversing rollers 4, 5, 6, 7 and 8 as tensioning rollers.

For a secure guiding of the piece of laundry, especially in the area from the reversing roller 5 to cylinder 2 and from cylinder 2 to the reversing roller 6, laundry guiding betls 14 are additionally provided, preferably inside the heat-insulated casing 26, which are guided over reversing rollers 5, 6, 15 and 16 and over cylinder 2. A tensioning device 17 is preferably arranged between reversing roller 15 and reversing roller 16. Each laundry guide belt 14 is separately tensionable by this tensioning arrangement 17. The laundry guide belts 14 herein are preferably arranged in such a way that, in each case, at least one laundry guide belt 14 rests on the conveyor belt 3 and a laundry guide belt 14 will always lie in each division of the conveyor belts 3. If several laundry guide belts 14 are used that rest on the conveyor belt 3, then the distance of all laundry guide belts 14 arranged over the entire width of cylinder 2 is preferably the same. The movement of the conveyor belts 3 and laundry guide belt 14 necessary for transporting the laundry pieces is derived from the rotation of the driven cylinder 2.

As shown in FIG. 1, a two-trough mangle is subsequently arranged to the described pre-heating or predrying unit. However, it is also possible to subsequently arrange only one or more than two trough mangle units, without departing from the concept of the invention. The trough mangle unit possesses, essentially, one heated mangle trough 19 and a perforated mangle cylinder 18 wrapped with an air-permeable, preferably plastic covering. The mangle cylinder 18, and also the mangle troughs 19, are mounted in the frame 20.

The ironing pressure necessary for smoothing and further drying the laundry is achievable and adjustable by means not illustrated, such as pneumatic cylinders. Preferably, the mangle cylinder 18 herein is pressed into the mangle trough 19. The drive of the mangle cylinder 18 herein is designed in such a way that circumferential speed is slightly greater than that of cylinder 2. The circumferential speed of the mangle cylinder following the mangle cylinder is also slightly higher than that of mangle cylinder 18. In addition, each mangle cylinder 18 is connected to a suction device (not shown) for drawing off steam occurring in the drying of the washing.

A heated trough bridge 21 is arranged at the exit of mangle trough 19 to transfer the pieces of laundry from the first to the second trough unit, the trough bridge also communicating with the entrance of the following mangle trough.

Laundry guiding belts 22 are provided in order to safely guide the pieces of laundry in the trough mangle, especially in the area of trough bridge 21; the laundry guiding belts are guided around the rollers 23 and 24, in the vicinity of the ironing area of the mangle troughs 19 around the mangle cylinder 18 and between the mangle cylinders over trough bridge 21. A tensioning device 25 makes it possible to separately stretch each laundry guiding belt 22. The laundry guiding conveyors 22 may be completely arranged within or locally outside the casing 26. Movement of the laundry guiding conveyors 22 is effected by the rotating movement of the mangle cylinder 18 or by the mangle cylinders, when several mangle units are provided.

The forwarding arrangement 28 of a folding machine may, for example, be arranged at the exit of the last trough mangle unit of the apparatus of the present invention.

In order to most extensively prevent thermal energy losses, this apparatus for smoothing and drying damp laundry has a thermally insulated casing 26. In addition a protective device 27 is provided at the laundry entrance, in feed region 3*a*, which, when the apparatus is in operation, protects the entire apparatus on operation. In the case of shutting-off of the appartus of this invention, an additional controlled, switchable, preferably electromagnetic brake acts upon cylinder 2.

Figure 2:
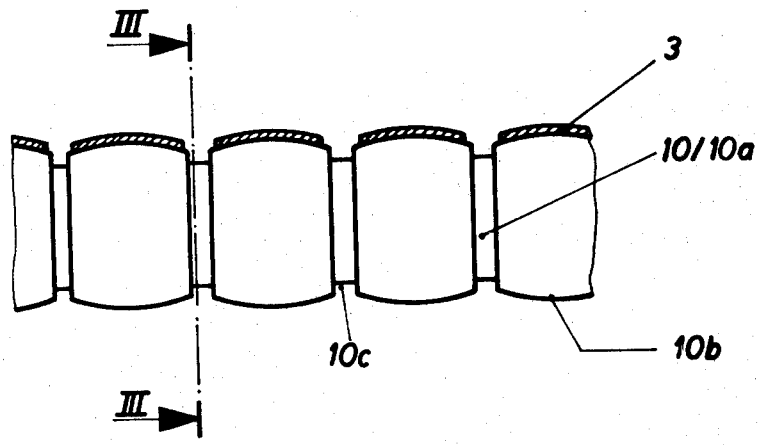
FIG. 2 illustrates a schematic representation of the guiding roller.
Figure 3:
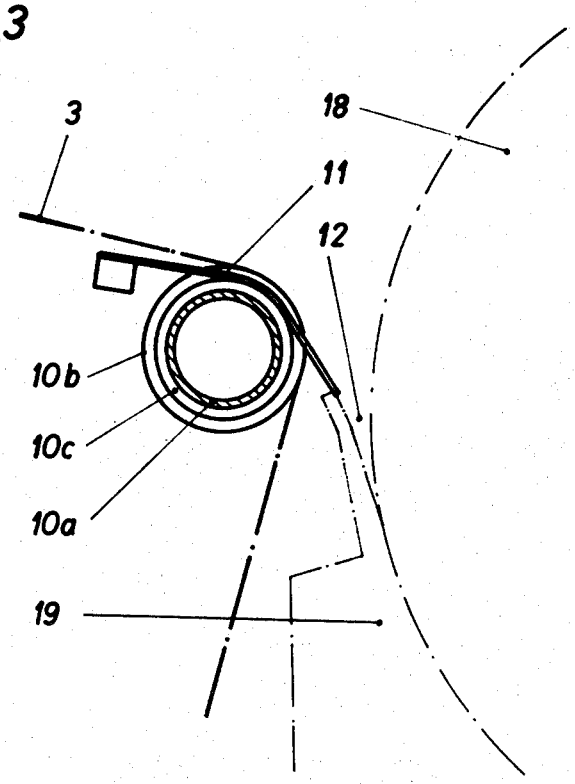
FIG. 3 is a cross-sectional view taken along line III—III of FIG. 2.

FIGS. 2 and 3 show the diagrammatic representation of the guiding roller 10. The guiding roller 10, which is rotatably mounted in frame 1, comprises basic roller body 10*a* with the spherical guiding elements 10*b* assembled thereon at a distance from each other. A conveyor belt 3 runs on each guiding element 10*b*. Gears 10*c* are additionally provided between the spherical guiding elements 10*b*, in which transfer brackets are arranged.

We claim:

1. An apparatus for drying and ironing laundry comprising:

a substantially closed, heat-insulating casing;

at least one heated, driven cylinder mounted in said casing;

first and last mangle units mounted in said casing;

means for guiding laundry to be dried to said cylinder comprising a conveyor belt system positioned around a series of rollers and substantially passing around a portion of the circumference of said cylinder, and including an initial, upwardly inclined area for receiving laundry before said cylinder, and a subsequent downwardly inclined area after said cylinder for transferring laundry to be ironed;

said mangle units having operatively associated therewith an integrated belt system receiving laundry from said downwardly inclined area of said conveyor belt system and transporting laundry from one of said mangle units to the other;

a portion of said integrated belt system travelling from said last mangle unit to said first mangle unit outside said casing.

2. An apparatus for drying laundry to be ironed comprising (A) a first heated, rotatable cylinder, (B) a closed heat insulating casing substantially enclosing said cylinder (A) to prevent as much heat as possible from escaping to the atmosphere;

(C) means for guiding laundry to be dried to said cylinder (A), said means in the form of a first conveyor belt positioned around a series of rollers and substantially passing around a portion of the circumference of said cylinder, said belt compirsing an initial, upwardly inclined area for receiving laundry before said cylinder, and a subsequent downwardly inclined area after said cylinder for transferring laundry to be ironed;

(D) a device for tensioning said conveyor belt (C) positioned at a point in the path of said belt which does not carry any laundry;

(E) a second guiding belt for said laundry positioned around its own set of rollers and mating with said conveyor belt (C) just prior to said cylinder (A) and disengaging from said conveyor belt (C) just after said cylinder (A);

(F) a device for tensioning said guiding belt (E) which is positioned at a point in the path of said guiding belt not engaging said conveyor belt (C);

(G) a second cylinder;

(H) at least one mangle trough, said mangle trough substantially enclosing said first cylinder (A);

(I) a guiding roller situated against said first conveyor belt (C) at the end of said downwardly inclined transfer section;

(J) fingers situated on said guiding roller for transferring laundry to be ironed from said first conveyor belt (C) to a path between said second cylinder (G) and said mangle trough (H);

(K) a third belt for guiding laundry to be ironed between said second cylinder (G) and said mangle trough (H), said third belt positioned about its own set of rollers; and (L) a device for tensioning said third belt (K) positioned at a point on the path of said guiding belt not passing between said second cylinder (G) and said mangle trough (H).

3. The apparatus of claim 2 additionally comprising (G) and (H) a plurality of additional cylinders and mangle troughs, (M) a trough bridge between each adjacent pair of cylinders (G) and mangle troughs (H) for transferring laundry to be ironed from one cylinder and trough to an adjacent cylinder and trough, said guiding belt (K) passing between each cylinder and trough and over each trough bridge, and (N) a device for de-activating rotation of all of said cylinders and movement of all of said belts, situated near the upwardly inclined area of said conveyor belt (C).

4. A method of pre-drying and ironing laundry comprising:

directing laundry around a heated, rotating cylinder in an enclosed area to conserve heat, by means of a complementary pair of belts, one belt receiving laundry before said cylinder and transferring laundry after said cylinder, and said other belt for guiding laundry about said cylinder, said two belts mating just prior to said cylinder and disengaging from one another just after said cylinder; and ironing the thus pre-dried laundry by passing said pre-dried laundry through at least one corresponding cylinder and mangle trough by means of an additonal belt.

* * * * *